US007438653B2

(12) United States Patent
Anderson

(10) Patent No.: US 7,438,653 B2
(45) Date of Patent: Oct. 21, 2008

(54) ATHLETIC SWING TRAINING DEVICE

(75) Inventor: Sandra L. Anderson, Salina, KS (US)

(73) Assignee: AnderMort LLC, Salina, KS (US)

( * ) Notice: Subject to any disclaimer, the term of this patent is extended or adjusted under 35 U.S.C. 154(b) by 37 days.

(21) Appl. No.: 11/592,096

(22) Filed: Nov. 1, 2006

(65) Prior Publication Data

US 2008/0102971 A1 May 1, 2008

(51) Int. Cl.
*A63B 69/00* (2006.01)

(52) U.S. Cl. ..... 473/458; 473/422

(58) Field of Classification Search ..... 473/422, 473/450, 458, 464, 428, 207, 215, 216; 482/124, 482/125, 121, 122, 130, 129; 434/252; 119/770
See application file for complete search history.

(56) References Cited

U.S. PATENT DOCUMENTS 475,432 A * 5/1892 Blades ..... 473/415
2,661,888 A * 12/1953 Sidlinger ..... 182/3
3,069,169 A * 12/1962 Topping ..... 473/212
3,491,726 A * 1/1970 Partin ..... 119/770
3,550,937 A * 12/1970 Patterson et al. ..... 473/428
3,703,286 A * 11/1972 Adkin ..... 473/428
3,870,317 A * 3/1975 Wilson ..... 473/216
4,667,624 A * 5/1987 Smith ..... 119/770
5,009,420 A * 4/1991 Martelli ..... 473/458
5,048,836 A 9/1991 Bellagamba
5,358,250 A * 10/1994 Spencer ..... 473/216
5,842,444 A * 12/1998 Perrulli ..... 119/770
5,950,569 A * 9/1999 Perrulli ..... 119/770
6,012,993 A 1/2000 Guerriero
6,095,936 A * 8/2000 Kirkpatrick et al. ..... 473/450
6,120,418 A 9/2000 Plough
6,283,877 B1 * 9/2001 Cook ..... 473/450
6,296,582 B1 * 10/2001 Minniear ..... 473/428
6,755,755 B2 * 6/2004 Wah Loh ..... 473/458
6,786,855 B2 9/2004 Prichard

* cited by examiner

*Primary Examiner*—Mitra Aryanpour
(74) *Attorney, Agent, or Firm*—Jeffrey L. Thompson; Thompson & Thompson, P.A.

(57) ABSTRACT

A device and method are provided for training a person to swing a bat or club while rotating the person's hips. The device includes a belt for attaching around a person's hips, a restraint device attached to the back side of the belt, and an anchor system slidably attached to the restraint device. The restraint device can be a nylon strap sewn to the back side of the belt. The anchor system comprises a flexible member, such as a rope, with a first ring attached at one end for slidable attachment to the restraint device. The other end of the anchor system can be tethered to a stationary object or held by a coach. A clip can be attached to the restraint device for limiting the extent of movement of the anchor system along the restraint device and for providing a reference point for swing training.

14 Claims, 4 Drawing Sheets

ATHLETIC SWING TRAINING DEVICE

BACKGROUND OF THE INVENTION

1. Field of the Invention

The present invention relates generally to the field of sports training devices and methods. In particular, the present invention relates to a swing training device and method for conditioning people to improve their swing by encouraging them to rotate their hips.

2. Description of the Related Art

Certain sports activities, including baseball, softball, and golf, require an athlete to swing a bat or a club to hit a ball. The particular technique used to swing the bat or club can make a significant difference in the amount of hitting force imparted to the ball. A proper swinging technique will cause the bat or club to impart more force to the ball, resulting in the ball being hit harder and traveling a longer distance. An important part of a proper swinging technique is the amount of hip rotation during the swing. By rotating the hips during the swing, a much stronger swing can be attained, resulting in more power and distance imparted to the ball.

Various swing training devices have been provided in the prior art. For example, U.S. Pat. No. 5,048,836 issued to Bellagamba provides an athletic swing practice apparatus having a lower back support belt with an arrangement of straps that attach to a person's thighs, waist, and buttocks. A pair of resilient cords extend from the support belt to stationary members in front and behind the person. The resilient cords provide a continuous force around the person's waist while practicing, thereby tending to prevent the person from twisting his hips and lower spine.

Another prior art swing training device is disclosed in U.S. Pat. No. 6,012,993 issued to Guerriero. This device also includes a waist belt with an arrangement of straps that attach to a person's thighs, waist and buttocks. A plurality of connector loops are provided on the belt at various locations around the person's waist. A tether is attached to one of the connector loops and held by a trainer or tied to a stationary object. The tether is used to apply a force to the belt to resist a forward swing of the person, thereby impeding the swing and tending to prevent the person from twisting his hips.

Another prior art swing training device is disclosed in U.S. Pat. No. 6,786,855 issued to Prichard. This device includes a hip retaining assembly that attaches around a person's hips, and an arrangement of vertical tubes for supporting the hip retaining assembly above a base platform. A torsion spring is provided at the bottom of one of the vertical tubes so that during use the hip retaining assembly resists twisting movement of the user in the hip area. Another prior art swing training device that functions in a similar manner is shown in U.S. Pat. No. 6,120,418 issued to Plough.

While these prior art swing training devices are presumed to have been useful for their intended purpose, there exists a need for an improved device and method for training athletes to have a proper swinging technique.

SUMMARY OF THE INVENTION

It is an object of the present invention to provide an improved device and method for training athletes to have a proper swinging technique to improve their sports performance.

It is a further object of the present invention to provide a swing training device and method that encourages hip rotation during a swing to provide a stronger swing that results in more power and distance imparted to the ball.

It is a further object of the present invention to provide a swing training device that is inexpensive to manufacture, simple to use, effective for its intended purpose and useful for a variety of different sports, durable in its construction, and capable of a long operating life.

In order to accomplish these and other objects of the invention, a device and method are provided for training a person to swing a bat or club while rotating the person's hips. The device includes a belt for attaching around a person's hips, a restraint device attached to the back side of the belt, and an anchor system slidably attached to the restraint device. The restraint device can be a nylon strap sewn to the back side of the belt. The anchor system comprises a flexible member, such as a rope, with a first ring attached at one end for slidable attachment to the restraint device. The other end of the anchor system can be tethered to a stationary object or held by a coach. A clip can be attached to the restraint device for limiting the extent of movement of the anchor system along the restraint device and for providing a reference point for swing training. During a swing with proper rotation of the hips, the first ring of the anchor system will slide from its starting point on the rear hip of the person, to an ending point near or beyond the center of the person's backside.

According to a broad aspect of the present invention, a swing training device is provided, comprising: a belt for attaching around a person's hips; a restraint device having first and second ends attached to the belt and a slide portion extending along a back side of the belt; and an anchor system slidably attached to the restraint device for slidable movement along the restraint device between the first and second ends, the anchor system comprising a flexible member for tethering the anchor system to an object.

According to another broad aspect of the present invention, a method of training a person to perform a sports activity is provided, comprising the steps of: attaching a belt around a person's hips below the person's waist, the belt having a restraint device with a slide extending along a back side of the belt; attaching one end of an anchor system to the restraint device for sliding movement along the slide; tethering another end of the anchor system to an object; and allowing the anchor system to slide along the restraint device upon rotation of a person's hips while training for the sports activity, whereby the person is conditioned to perform the sports activity while rotating the person's hips.

According to another broad aspect of the present invention, a method of training a person to perform a sports activity is provided, comprising the steps of: attaching a belt around a person's hips below the person's waist, the person having a front hip and a rear hip relative to a direction of swinging, the belt having a restraint device with a slide extending along a back side of the belt from a first point on the rear hip to at least a second point near a center of the person's backside; providing an anchor system having a first ring attached to an end of a flexible member; attaching the first ring of the anchor system to the restraint device for sliding movement along the slide; tethering the flexible member of the anchor system to an object so that the first ring is pulled toward the first point on the slide when the person stands in a ready position at the start of a swing; and allowing the first ring of the anchor system to move along the slide of the restraint device from the first point to the second point upon rotation of the person's hips while training for the sports activity, whereby the person is conditioned to perform the sports activity while rotating the person's hips.

Numerous other objects and features of the present invention will be apparent to those skilled in this art from the following description wherein there is shown and described embodiments of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figures 1, 2, 3:
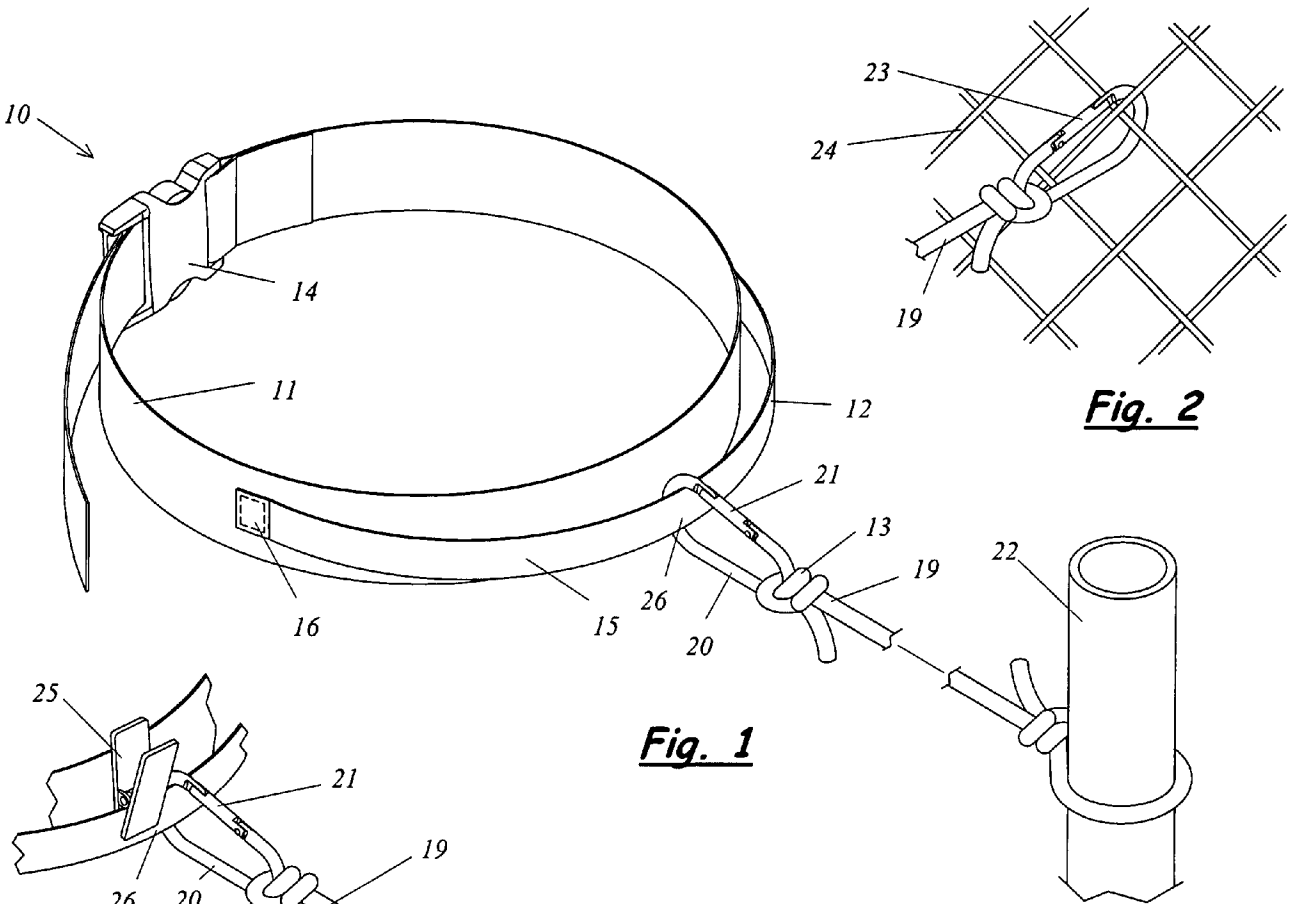
FIG. 1 is a perspective view of a swing training device according to the present invention, with the anchor system attached to a stationary pole.
FIG. 2 is a perspective view of another embodiment in which a second ring is attached at a distal end of the anchor system to aid in attaching to a fence or other stationary object.
FIG. 3 is a perspective view showing a clip attached to the slide portion of the restraint device for providing a reference point during rotation of the user's hips as the anchor system moves along the slide portion.
Figure 4:
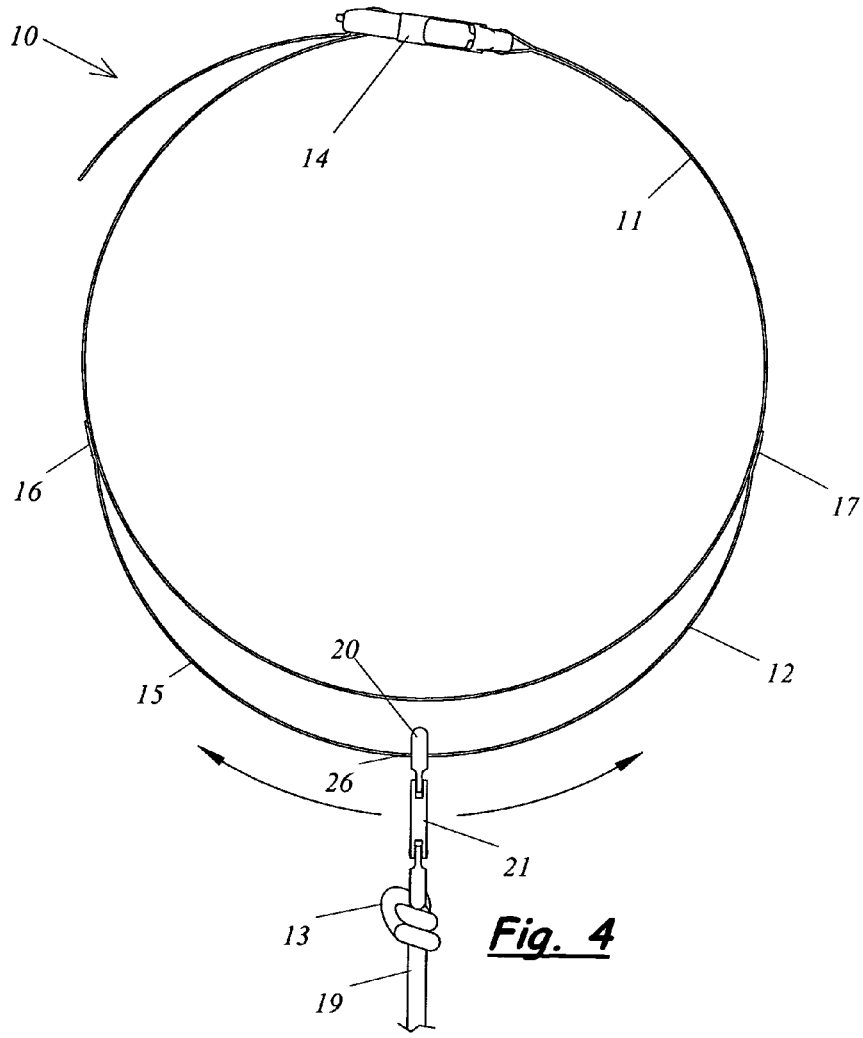
FIG. 4 is a plan view of the swing training device of the present invention.
Figure 5:
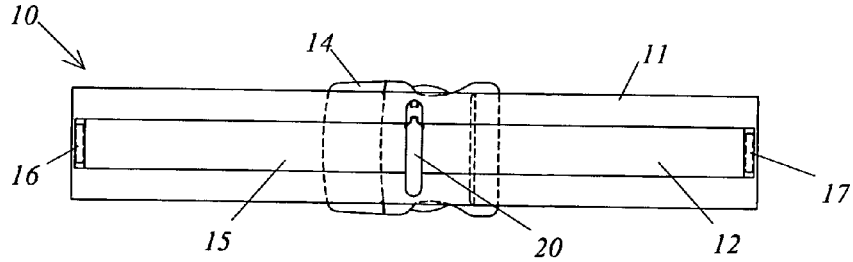
FIG. 5 is a rear elevation view of the swing training device of the present invention.

A swing training device 10 and method according to the present invention will now be described in detail with reference to FIGS. 1 to 11 of the accompanying drawings.

The swing training device 10 of the present invention includes three main components: a belt 11, a restraint device 12, and an anchor system 13. The restraint device 12 is provided on a backside of the belt 11, and the anchor system 13 is slidably attached to the restraint device 12. Each of these components and the method of using the device 10 will be described in detail below.

The belt 11 is used to attach the device 10 around a person's hips, preferably just below the person's waistline. The belt 11 has an adjustable slide buckle 14 for buckling and unbuckling the ends of the belt 11 together to attach the device to the user. The slide buckle 14 is adjustable for adapting the belt 11 to fit snugly around different sized people.

In one exemplary embodiment, the belt 11 is made with a nylon webbing material, such as 2-inch wide HB nylon webbing having a rated tensile strength of about 4,000 lbs and a thickness of about 0.050 inches. For example, the nylon webbing material can be a professional grade nylon webbing typically used on good quality luggage and backpacks. The nylon webbing material can have a herringbone weave for extra resilience, similar to automotive seatbelt webbing. The ends of the nylon webbing are heat sealed for a neat look and to prevent fraying. The belt 11 is sewn with a modified box stitched pattern on an industrial sewing machine with heavy duty nylon thread. The thread is preferably tough and strong, yet thin enough for standard needles.

The restraint device 12 is attached to the backside of the belt 11 and provides a slide 15 for the anchor system 13. A first end 16 of the restraint device 12 is attached at a location on the belt 11 near one of the user's hips, and a second end 17 of the restraint device is attached at a location on the belt 11 near the other hip and diametrically opposite on the belt 11 from the first end 16. The restraint device 12 can be a nylon strap having its first and seconds ends 16, 17 sewn or otherwise attached (e.g., by adhesive) to the backside of the belt 11. For example, a 1-inch wide nylon webbing can be used as the restraint device 12.

Because the restraint device 12 is only attached at its ends 16, 17, it provides the slide 15 along the backside of the belt 11. In the illustrated embodiment, the slide 15 extends along the backside of the belt 11 from the person's rear hip (relative to a direction of swinging) to the person's front hip. The symmetrical arrangement of the restraint device 12 on the belt 11 allows the swing training device 10 to be used by both right-handed and left-handed people. The right-side hip will be the rear hip for a right-handed swing, while the left-side hip will be the rear hip for a left-handed swing.

The anchor system 13 is slidably attached to the restraint device 12 for slidable movement along the slide portion 15 of the restraint device 12 between the first and second ends 16, 17. The anchor system 13 includes a flexible member 19, such as a rope, with a first ring 20 attached to an end thereof. The first ring 20 can be a D-shaped ring having a spring latch 21 on one side for providing a convenient means to attach to the slide 15 of the restraint device 12. The first ring 20 allows the anchor system 13 to be removably attached to the restraint device 12 for sliding movement along the slide 15.

A second end of the flexible member 19 is tethered to a stationary object or held by another person. For example, the second end of the flexible member 19 can be tied to a pole 22, as shown in FIG. 1, or the flexible member 19 can be held by the person's coach (not shown). In another embodiment shown in FIG. 2, a second ring 23 can be provided at the second end of the flexible member 19 for attaching the flexible member 19 to a backstop fence 24 or the like. For example, the second ring 23 can have the same D-shaped structure as the first ring 20.

As shown in FIG. 3, a clip 25 can be attached to a mid-point 26 on the slide 15 of the restraint device 12 for limiting an extent of movement of the anchor system 13 along the slide 15 and for providing a reference point for swing training. For example, the clip 25 can be a spring-biased clip with jaws that clamp over the strap of the restraint device 12 to provide a fixed stop for the first ring 20 of the anchor system 13 as it slides along the restraint device 12.

Figure 6:
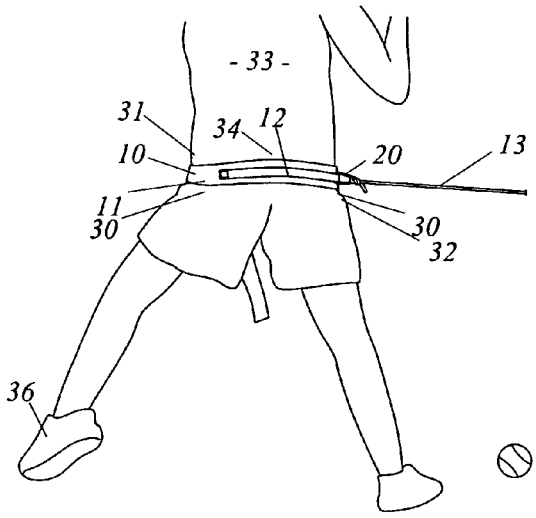
FIGS. 6 to 8 show a sequence of swinging a bat using the swing training device of the present invention.

A method of using the swing training device 10 for a batter's swing will now be described with reference to FIGS. 6 to 8. The swing training device 10 is attached by buckling the belt 11 around the batter's hips 30 below the batter's waist 31. The first ring 20 of the anchor system 13 is attached to the restraint device 12 for sliding movement along the slide 15, and the other end of the anchor system 13 is tethered to an object, such as a backstop fence or another person. The anchor system 13 is tethered behind the rear hip 32 of the batter 33 (relative to the direction of the swing) so that the first ring 20 is pulled toward a point on the slide 15 over the batter's rear hip 32 when the batter 33 stands in a ready position at the start of the batter's swing, as shown in FIG. 6.

Figure 7:
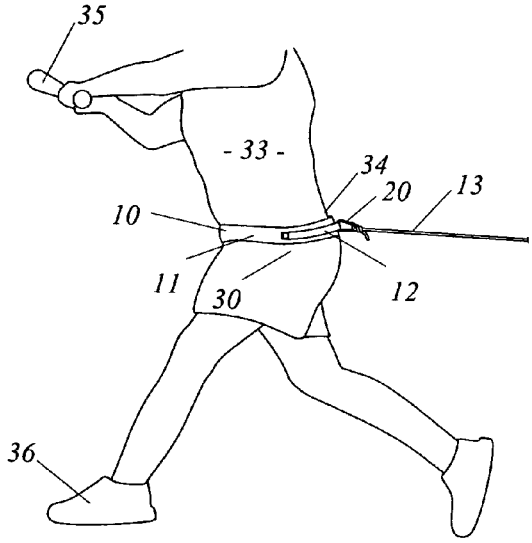
Figure 8:
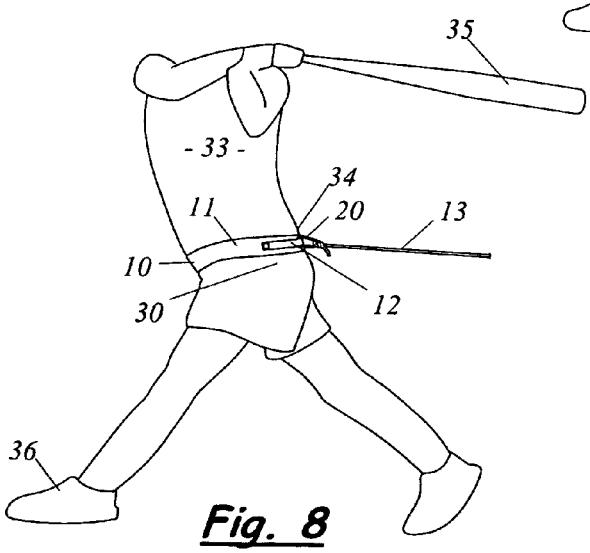

The first ring 20 of the anchor system 13 is then allowed to move along the slide 15 of the restraint device 12 from the rear hip 32 toward the center 34 of the batter's backside while the batter 33 rotates his or her hips 30 during the swing, as shown in FIG. 7. At the end of the swing, the first ring 20 of the anchor system 13 will have moved to a point near the center 34 of the batter's backside, as shown in FIG. 8. For example, a batter 33 may be conditioned to rotate his or her hips 30 so that the first ring 20 moves to a point near the center 34 of the batter's backside by the end of the batter's swing. The sliding movement of the anchor system 13 along the restraint device 12 conditions the batter to swing the bat 35 while rotating his or her hips 30.

The belt 11 of the swing training device 10 is preferably attached to the batter 33 around the hips 30 below the waist 31. The swing training device 10 can be tethered to anything behind the batter 33, such as the backstop, a pole, or held by another person, such as a coach or parent. The swing training device 10 can be used in a variety of batting drills or stations, including tee work, soft toss, short toss in a cage, pitching machine, and even live pitching. In general, the device 10 can be used anytime a batter 33 is swinging a bat 35.

The swing training device 10 prevents a batter 33 from developing a habit of gliding into the ball, which is a common mistake that results in a batter hitting off of his or her front foot 36 without using power from the lower body to drive the ball. The swing training device 10 can also correct a batter 33 who tends to over-stride because the device holds the batter 33 in a proper stance and only allows the batter 33 to raise his or her front foot 36 and put it right back down in the same position (i.e., no forward stride). As a result, the front foot 36 can only be used as a timing step when using the device 10, and cannot be used to lunge at the ball. By not striding out or lunging, the batter's head can stay focused on the ball to give a greater chance of hitting the ball with the batter's hips 30 behind the swing. The swing training device 10 corrects and strengthens the lower portion of the batter's swing and helps build the foundation for a much stronger swing resulting in more power and distance. Continued use of the swing training device 10 will develop muscle memory.

The clip 25 can be attached to the slide 15 of the restraint device 12 for limiting the extent of movement of the anchor system 13 along the slide 15 and for providing a reference point near the center 34 of the batter's backside at the end of the batter's swing. The batter 33 can be taught by repeatedly hitting the clip 25 during the rotation of his or her hips 30 from a closed position to an open position, again building muscle memory.

Figure 9:
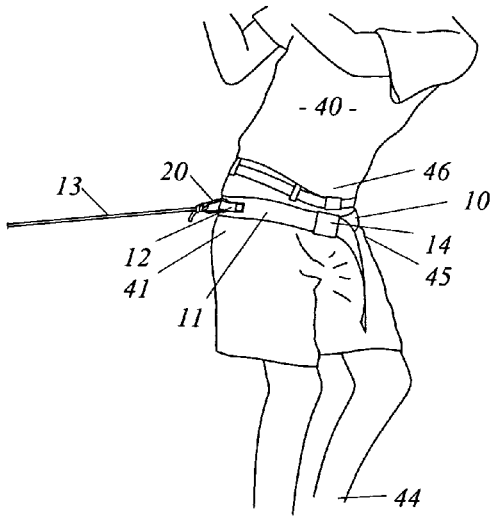
FIGS. 9 to 11 show a sequence of swinging a golf club using the swing training device of the present invention.

A method of using the swing training device 10 for a golf club swing will now be described with reference to FIGS. 9 to 11. The swing training device 10 is attached to the golfer 40 in the same manner as explained above with respect to a batter 33. The anchor system 13 is tethered to an object, such as a stationary pole or another person. The first ring 20 of the anchor system 13 is slid to a point over the rear hip 41 of the golfer 40 (relative to the direction of the swing) when the golfer 40 stands in a ready position at the start of a golf club swing, as shown in FIG. 9.

Figure 10:
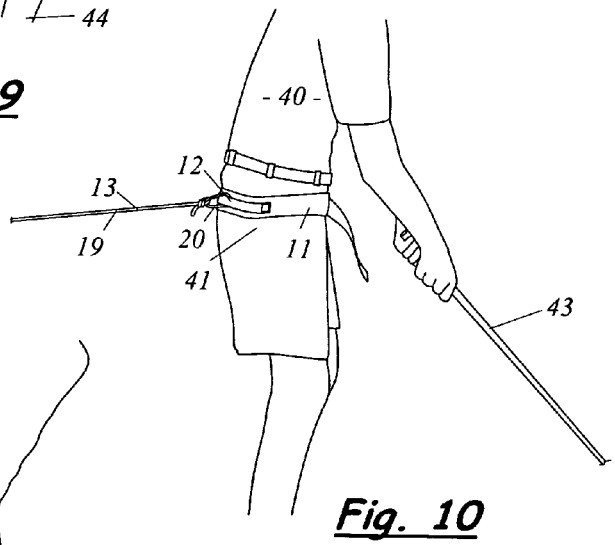
Figure 11:
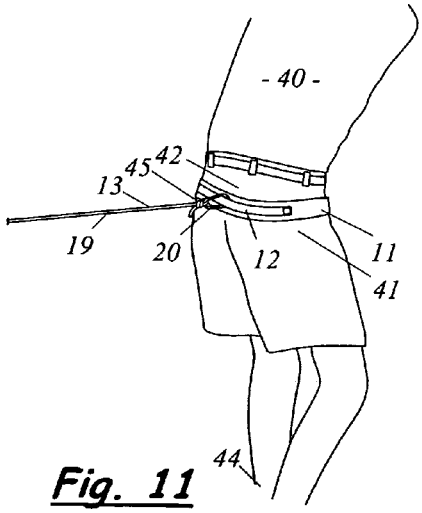

The first ring 20 of the anchor system 13 is then allowed to move along the slide 15 of the restraint device 12 from the rear hip 41 toward the center 42 of the golfer's backside while the golfer 40 rotates his or her hips during the swing, as shown in FIG. 10. At the end of the swing, the first ring 20 of the anchor system 13 will have moved past the center 42 of the golfer's backside, as shown in FIG. 11. For example, a golfer 40 may be conditioned to rotate his or her hips so that the first ring 20 moves about four inches beyond the center 42 of the golfer's backside by the end of the golf club swing. The sliding movement of the anchor system 13 along the restraint device 12 conditions the golfer 40 to swing the golf club 43 while rotating the golfer's hips.

The swing training device 10 can be used by golfers to teach good hip rotation and to facilitate proper weight balance in the lower body. The swing training device 10 will not allow the golfer to step with his lead foot 44. By drawing the golfer's attention to his or her hips with wearing the swing training device 10, the golfer 40 will make a conscious effort to keep the hips level. This keeps the golfer 40 from dipping the rear hip 41 and driving the ball into the air. When the golfer 40 wears the swing training device 10 at the driving range and hits over and over with his or her hips in the proper position, the golfer will build muscle memory for his or her game. Use of the swing training device 10 to learn hip rotation and not to dip the rear hip 41 will give the golfer 40 greater distance on all shots.

The clip 25 can be attached to the slide 15 of the restraint device 12 for limiting movement of the anchor system 13 along the slide 15 and for providing a reference point beyond the center 42 of the golfer's backside at the end of the golf club swing. This allows the golfer 40 to start with his or her front hip 45 pointed at the target, rotating the hips 41, 45 through the swing, and finishing to where the golfer's navel 46 is pointed at the target at the finish of the swing. The golfer 40 can be taught by repeatedly hitting the clip 25 during the rotation of the golfer's hips 41, 45 from a closed position to an open position, again building muscle memory.

The swing training device 10 of the present invention has been described for use in training a person to swing a bat or golf club. However, it should be understood that the invention may have other applications, such as being used to train a person to swing a tennis racket, to kick or throw a ball, or to perform other sports activities that can be improved by encouraging a person to rotate the hips while performing the activity.

While the invention has been specifically described in connection with specific embodiments thereof, it is to be understood that this is by way of illustration and not of limitation, and the scope of the appended claims should be construed as broadly as the prior art will permit.

What is claimed is:

1. A method of training for a sports activity, comprising the steps of:

attaching a belt around a person's hips below the person's waist, the belt having a restraint device with a slide extending along a back side of the belt;

attaching one end of an anchor system to the restraint device for sliding movement along the slide;

tethering another end of the anchor system to an object;

allowing the anchor system to slide along the restraint device upon rotation of a person's hips while training for the sports activity, whereby the person is conditioned to perform the activity while rotating the person's hips; and attaching a clip to a mid-point on the slide of said restraint device in a manner that provides a fixed stop at the mid-point of the slide for limiting an extent of movement of the anchor system along the slide and for providing a reference point for movement of the hips during the sports activity training.

2. The method according to claim 1, wherein said step of attaching the belt to a person's hips comprises positioning the belt with the slide of the restraint device extending across the backside of the person's hips.

3. The method according to claim 1, further comprising the step of providing a slide buckle on the belt, and adjusting the slide buckle so that the belt fits snugly around the person's hips below the person's waist.

4. The method according to claim 1, wherein said belt comprises a nylon webbing and said restraint device comprises a nylon strap sewn to the back side of said nylon webbing, and wherein said step of attaching the belt to a person's hips comprises positioning the belt with the nylon strap extending across the backside of the person's hips.

5. The method according to claim 1, wherein said anchor system comprises a rope with a first ring attached to an end thereof, and further comprising the step of attaching said first ring to the restraint device for sliding movement along the slide.

6. The method according to claim 5, wherein said anchor system comprises a second ring attached to another end of the rope, and further comprising the step of tethering the anchor system by attaching the second ring to a stationary object.

7. The method according to claim 1, wherein the person has a front hip and a rear hip relative to a direction of swinging, and said clip is attached to the slide near a center of the person's backside between the front and rear hips, whereby the anchor system is movable along the slide from a first point on the side of the rear hip to a second point near the center of the person's backside for conditioning a person to swing a bat properly.

8. The method according to claim 1, wherein the person has a front hip and a rear hip relative to a direction of swinging, and said clip is attached to the slide between a center of the person's backside and the front hip, whereby the anchor system is movable along the slide from a first point on the side of the rear hip to a second point beyond the center of the person's backside for conditioning a person to swing a club properly.

9. The method according to claim 1, wherein the step of tethering the anchor system comprises having another person hold the anchor system.

10. A method of training a person to perform a sports activity, comprising the steps of:

attaching a belt around a person's hips below the person's waist, the person having a front hip and a rear hip relative to a direction of swinging, the belt having a restraint device with a slide extending along a back side of the belt from a first point on the rear hip to at least a second point near a center of the person's backside;

providing an anchor system having a first ring attached to an end of a flexible member;

attaching the first ring of the anchor system to the restraint device for sliding movement along the slide;

tethering the flexible member of the anchor system to an object so that the first ring is pulled toward the first point on the slide when the person stands in a ready position at the start of a swing;

allowing the first ring of the anchor system to move along the slide of the restraint device from the first point to the second point upon rotation of the person's hips while training for the sports activity, whereby the person is conditioned to perform the sports activity while rotating the person's hips; and attaching a clip to a mid-point on the slide of said restraint device in a manner that provides a fixed stop at the mid-point of the slide for limiting an extent of movement of the anchor system along the slide and for providing a reference point for movement of the hips during the sports activity training.

11. The method according to claim 10, wherein said belt comprises a nylon webbing and said restraint device comprises a nylon strap sewn at its ends to the back side of said nylon webbing, and wherein said step of attaching the belt to a person's hips comprises positioning the belt with the nylon strap extending across the backside of the person's hips.

12. The method according to claim 10, wherein said anchor system comprises a second ring attached to another end of the flexible member, and wherein said step of tethering the flexible member comprises attaching the second ring to a stationary object.

13. The method according to claim 1, wherein said step of attaching a clip comprises clamping jaws of a spring-biased clip onto the slide to provide a fixed stop on the slide.

14. The method according to claim 10, wherein said step of attaching a clip comprises clamping jaws of a spring-biased clip onto the slide to provide a fixed stop on the slide.

* * * * *